US005744913A

United States Patent [19]

Martich et al.

[11] Patent Number: 5,744,913

[45] Date of Patent: Apr. 28, 1998

[54] FLUORESCENT LAMP APPARATUS WITH INTEGRAL DIMMING CONTROL

[75] Inventors: Mark E. Martich, Hanover; Thomas E. Beling, Framingham; John M. Ossenmacher, Scituate, all of Mass.

[73] Assignee: Pacific Scientific Company, Weymouth, Mass.

[21] Appl. No.: 237,850

[22] Filed: May 3, 1994

Related U.S. Application Data

[63] Continuation-in-part of Ser. No. 217,936, Mar. 25, 1994, abandoned.

[51] Int. Cl.[6] ..... H05B 37/02

[52] U.S. Cl. ..... 315/158; 315/56; 315/150; 315/151; 315/156; 250/205; 250/206; 250/214 D; 250/214 AL

[58] Field of Search ..... 315/150, 151, 315/156, 158, DIG. 4, 56; 250/205, 206, 214 AL, 214 D

[56] References Cited

U.S. PATENT DOCUMENTS

| | | | |
|---|---|---|---|
| 3,331,013 | 7/1967 | Cunningham | 323/22 |
| 3,450,941 | 6/1969 | Butts | 315/194 |
| 4,016,451 | 4/1977 | Engel | 315/158 |
| 4,125,767 | 11/1978 | Silver | 250/214 |
| 4,284,925 | 8/1981 | Bessone et al. | 315/240 |
| 4,414,489 | 11/1983 | Young | 315/51 |
| 4,443,740 | 4/1984 | Goralnik | 315/284 |
| 4,612,479 | 9/1986 | Zansky | 315/194 |
| 4,651,060 | 3/1987 | Clark | 315/199 |
| 4,677,345 | 6/1987 | Nilssen | 315/209 |
| 4,682,083 | 7/1987 | Alley | 315/307 |
| 4,739,227 | 4/1988 | Anderson | 315/260 |
| 4,874,989 | 10/1989 | Nilssen | 315/151 |
| 4,894,587 | 1/1990 | Jungreis et al. | 315/200 |
| 4,933,605 | 6/1990 | Quazi et al. | 315/224 |
| 4,950,963 | 8/1990 | Sievers | 315/360 |
| 4,954,768 | 9/1990 | Luchaco et al. | 323/300 |
| 4,988,921 | 1/1991 | Ratner et al. | 315/159 |
| 4,998,044 | 3/1991 | Nilssen | 315/200 |
| 5,001,386 | 3/1991 | Sullivan et al. | 315/219 |
| 5,003,230 | 3/1991 | Wong et al. | 315/279 |
| 5,004,959 | 4/1991 | Nilssen | 315/291 |
| 5,004,972 | 4/1991 | Roth | 323/320 |
| 5,030,887 | 7/1991 | Guisinger | 315/158 |
| 5,039,914 | 8/1991 | Szuba | 315/158 |
| 5,041,763 | 8/1991 | Sullivan et al. | 315/176 |
| 5,083,081 | 1/1992 | Maiale, Jr. et al. | 315/291 |
| 5,084,653 | 1/1992 | Nilssen | 315/219 |
| 5,086,249 | 2/1992 | Blaisdell et al. | 313/318 |

(List continued on next page.)

FOREIGN PATENT DOCUMENTS

| | | | |
|---|---|---|---|
| 2 346 935 | 10/1977 | France . | |
| 42 02 486A1 | 7/1993 | Germany . | |
| 1085830 | 10/1967 | United Kingdom | 250/239 |
| WO 90/00830 | 1/1990 | WIPO . | |
| WO 90/09729 | 8/1990 | WIPO . | |
| WO 93/09649 | 5/1993 | WIPO . | |

OTHER PUBLICATIONS

Portions of Catalog — Philips Lighting, "Lamp Specification and Application Guide," Cover Page, Back Page, pp. 11, 61–64, 78 (May 1993).

Catalog — OSRAM, "OSRAM DELUX®, Compact Fluorescent Lamps," pp. 1–15 (Jul. 1993).

*Primary Examiner*—Robert Pascal
*Assistant Examiner*—Arnold Kinkead
*Attorney, Agent, or Firm*—Lahive & Cockfield, LLP; W. Hugo Liepmann; Anthony A. Laurentano

[57] ABSTRACT

Dimmable fluorescent lamp apparatus includes a dimming control element housed in an integral adapter having a base which installs directly on an existing incandescent or other lighting fixture. The adapter mounts a fluorescent illumination element either fixedly or removably and replaceably. The lamp apparatus includes a manually accessible adjustment element connected with the control element and mounted on the adapter. The adjustment element can be an electrical adjustment element or an optical adjustment element.

12 Claims, 6 Drawing Sheets

U.S. PATENT DOCUMENTS

| | | | |
|---|---|---|---|
| 5,089,751 | 2/1992 | Wong et al. | 315/279 |
| 5,097,181 | 3/1992 | Kakitani | 315/209 |
| 5,172,033 | 12/1992 | Smits | 315/224 |
| 5,172,034 | 12/1992 | Brinkerhoff | 315/307 |
| 5,175,477 | 12/1992 | Grissom | 315/291 |
| 5,192,896 | 3/1993 | Quin | 315/224 |
| 5,194,782 | 3/1993 | Richardson et al. | 315/291 |
| 5,198,726 | 3/1993 | Van Meurs et al. | 315/224 |
| 5,214,356 | 5/1993 | Nilssen | 315/224 |
| 5,233,270 | 8/1993 | Nilssen | 315/58 |
| 5,237,243 | 8/1993 | Chung | 315/219 |
| 5,245,253 | 9/1993 | Quazi | 315/224 |
| 5,296,783 | 3/1994 | Fischer | 315/64 |

FLUORESCENT LAMP APPARATUS WITH INTEGRAL DIMMING CONTROL

This application is a continuation-in-part application of the commonly assigned and U.S. application Ser. No. 08/217,936, now abandoned filed on Mar. 25, 1994, entitled "Fluorescent Lamp Apparatus With Integral Dimming Control."

This application is related to commonly assigned U.S. utility patent application Ser. No. 08/236,958, now abandoned entitled "Fluorescent Lamp Apparatus With Remote Dimming Control" (Attorney Docket No. FSM-053) filed concurrently herewith, and, to commonly assigned to U.S. design patent application Ser. No. 29-022187, entitled "Dimmable Fluorescent Lamp Apparatus" (Attorney Docket No. FSM-052), filed on or about 29 Apr. 1994. Each related application is hereby incorporated by reference into this application.

TECHNICAL FIELD

This invention relates to fluorescent lamps and lamp adapters and more particularly to those which include an integral dimming control.

BACKGROUND OF THE INVENTION

Fluorescent lamps are gas discharge devices which provide illumination as a result of atomic excitation of a low-pressure gas, such as mercury, within the lamp envelope. The excited mercury atoms emit invisible ultraviolet radiation which is converted to visible light as a result of excitation of a fluorescent material deposited on the inside surface of the lamp envelope. The fluorescent coating material can be selected to emit visible radiation over a wide spectrum of colors and intensities.

The atoms of mercury vapor in the fluorescent lamp are excited by means of an electrode in the lamp which is ignited and operated at a relatively high voltage. A ballast circuit is commonly provided with the lamp to start the lamp and to operate it at the voltage and current required for fluorescent illumination.

Fluorescent lamps can include other control circuitry to enhance performance. For example, U.S. Pat. No. 4,933,605 to Quazi et al. discloses a fluorescent dimming ballast circuit which enables a fluorescent lamp to be selectively dimmed. U.S. Pat. No. 5,245,253 to Quazi et al. discloses improvements to the dimming circuit.

These prior systems for attaining dimmable fluorescent illumination typically employ a control circuit connected to a lighting fixture that mounts a fluorescent tube or other fluorescent bulb. A separate adjustable dimming control element is mounted at an accessible location separate from the fixture and is wired to the fixture. A common installation of this type has a permanently mounted ceiling fixture and a wall mounted control element.

The prior practices for attaining dimmable fluorescent lighting were not suited for installation of a fluorescent lamp in conventional incandescent lighting fixtures.

It accordingly is an object of this invention to provide dimmable fluorescent lamp apparatus that is convenient to install in existing lighting fixtures, including incandescent fixtures.

Other objects are to provide such dimmable fluorescent lamp apparatus that is convenient to adjust and that is compact.

Yet another object of this invention is to provide dimmable lamp apparatus having the attributes of convenient installation, convenient adjustment and compact size.

Still another object of this invention is to provide dimmable fluorescent lamp apparatus having which is locally and, optionally, automatically dimmable.

Further objects of the invention pertain to electric control circuits for operating a fluorescent lamp selectively to provide a selected level of illumination.

Other objects of the invention will in part be obvious and will in part appear hereinafter.

SUMMARY OF THE INVENTION

The invention attains the foregoing objects by providing dimmable fluorescent lamp apparatus that includes a dimming control element housed integrally with the illumination element and the lamp ballast circuit. The lamp apparatus according to the invention can be installed directly on an existing incandescent light fixture, as by screwing it into the conventional lamp socket, or wired directly to an existing non-incandescent light fixture. The lamp apparatus of the invention includes a dimming control circuit and has a knob, control ring, or other manually accessible control element connected with the control circuit. The lamp apparatus mounts a fluorescent illumination element, either fixedly assembled therewith or removable and replaceable by way of a socket. The dimmable fluorescent lamp apparatus thus enables an existing lighting fixture to provide controllable, i.e., selectively dimmable and, conversely, brightenable, fluorescent illumination without remote wiring and by means of a manually accessible control element directly on the lamp apparatus, and hence, integral with it.

One embodiment of the invention includes dimmable fluorescent lamp apparatus having an electrical socket base, an electrically insulative housing mounting the base at a bottom end of the housing, a controllable electrical circuit element disposed within the housing, and an electrical adjustment element having a manually positionable and manually accessible knob, ring or other element carried on the housing and connected with the controllable circuit element. The electrical socket base is threadable into an incandescent lamp socket and has two electrical conductors arranged for electrical connection with corresponding conductors of the electrical lamp socket. The electrically insulative housing has top and bottom ends axially spaced apart and includes a lamp supporting element at its top end for mountingly receiving a fluorescent illumination element, typically having four electrical contacts. The housing further includes a tubular portion which extends axially between the base at the bottom end and the lamp supporting element at the top end of the housing. The controllable electrical circuit element is connected within the housing with the two electrical conductors in the base for receiving electrical power. It further includes output conductors for electrical connection to the electrical contacts of the fluorescent illumination element. The controllable circuit element applies an adjustable operating electrical excitation to the fluorescent illumination element in response to a controllable electrical signal. Manual adjustable positioning of the adjustment element produces the electrical signal that operates the controllable circuit element to selectively excite the fluorescent illumination element to produce a correspondingly selected level of illumination.

The apparatus of the present invention thus combines superior fluorescent light output control with individual adjustability in a single fluorescent lamp which fits into existing electrical lamp fixtures.

In one practice of the invention, the manually positionable adjustment element is movable along the circumference of the housing tubular portion, for example, about a longitudinal housing axis which extends between the housing base and the top of the housing. In a preferred embodiment, the adjustment element includes a manually accessible ring member which extends around the circumference of the housing tubular portion.

In another practice, the manually positionable adjustment element is a knob or dial which is rotatable about an axis transverse to the longitudinal axis of the housing.

The invention can be practiced with a fluorescent illumination element mountingly secured in the lamp supporting element on the housing. The electrical contacts of the fluorescent illumination element are fixedly connected with the output conductors of the control circuit.

In another practice of the invention, the dimmable fluorescent lamp apparatus includes a socket-like lamp supporting element which provides for removable and replaceable mounting and electrical connection of the fluorescent illumination element.

Another embodiment of the invention provides a dimmable fluorescent lamp apparatus that includes an electrically insulative housing, a controllable electrical circuit element disposed within the housing, and an electrical adjustment element having a manually positionable and manually accessible knob, ring or other control element on the housing and connected with the controllable circuit element. The apparatus further includes a control element having a manually positionable and manually accessible switch on the housing and connected with the controllable circuit element and with a source of electrical power. The electrically insulative housing has top and bottom ends axially spaced apart and includes a lamp supporting element at its top end for mountingly receiving an illumination element, either incandescent or fluorescent, having electrical contacts. The housing further includes a tubular portion which extends axially between the bottom end of the housing and the lamp supporting element at the top end of the housing. The adjustment element includes a manually accessible ring member which extends externally around the circumference of the housing tubular portion. Turning the ring member relative to the housing operates the controllable circuit for selectively dimming, and brightening, the illumination. The control element includes a manually accessible switch which can be a toggle or other switch member. Movement of the switch relative to the housing initiates or terminates electrical current flow to the control circuit to begin or cease operation of the lamp.

A further embodiment of the invention provides a dimmable lamp apparatus that includes an electrical socket base, an electrically insulative housing mounting the base at the bottom end of the housing, a controllable electrical circuit element disposed within the housing, and an electrical adjustment element having a manually positionable and manually accessible knob, ring or other control element on the housing and connected with the controllable circuit element. The electrical socket base is threadable into an electric lamp socket and has two electrical conductors arranged for electrical connection with corresponding conductors of the electrical lamp socket. The electrically insulative housing has top and bottom ends axially spaced apart and includes a lamp supporting element at its top end for mountingly receiving an illumination element, either incandescent or fluorescent, having electrical contacts. The housing further includes a tubular portion which extends axially between the base at the bottom end of the housing and the lamp supporting element at the top end of the housing. The adjustment element includes a manually accessible ring member which extends externally-around the circumference of the housing tubular portion. Turning the ring member relative to the housing operates the controllable circuit for selectively dimming, and brightening, the illumination.

Yet another embodiment of the invention provides a dimmable fluorescent lamp apparatus that includes an electrical socket base, an electrically insulative housing mounting the base at the bottom end of the housing and having one or more apertures in the housing, and a controllable electrical circuit element disposed within the housing. The apparatus further includes one or more light sensing elements disposed within the housing and electrically connected with the controllable electrical circuit element. The apparatus further includes an optical adjustment element on the housing. The optical adjustment element is preferably manually accessible and positioned to control the entry of light through the apertures to the light sensing elements.

In one practice of the invention, the apertures are positioned in the top end of the housing to permit light originating from ambient surroundings and other illumination sources, as well as light resulting from operation of the fluorescent illumination element, to enter the housing and impinge on the light sensing elements therein. The light sensing elements are positioned within the housing beneath and proximal to the apertures to receive light from ambient surroundings, other illumination sources, and light produced from the fluorescent illumination element.

In one embodiment of the invention, the optical adjustment element includes a manually positionable ring member which has an aperture occluder proximal to each of the apertures. The aperture occluder is movable across the aperture in response to movement of the ring member around the periphery of the housing for variable occlusion of the ambient and/or fluorescent light impinging on the light sensing elements. The aperture occluder can be any part of the ring member which blocks passage of light to the light sensing elements. For example, if the apertures lie within the plane of the ring member, the aperture occluder can be an opaque region in the ring member. Alternatively, if the apertures are axially spaced from the plane of the ring member, the aperture occluder can be an extension of the ring member along the axis in the direction of the aperture, the extension being movable across the aperture to block passage of light to the light sensing elements. In a preferred embodiment, the aperture occluder is integrally formed with the ring member.

In another preferred embodiment of the invention, the apertures have protective panes which are preferably made of a transparent material or other material having a selected optical transmission.

A further feature of the invention is to provide an electric circuit for dimmable operation of a fluorescent lamp and which includes a rectifier for producing a rectified voltage in response to an alternating supply voltage. The rectifier, for example, can be a full-wave rectifier, a voltage doubler-type rectifier, or half-way rectifier. The circuit has output terminals for connection to a fluorescent lamp device and has a control converter. The control converter is connected with the rectifier receiving the rectified voltage and applied a switched current to the output terminals for operating a fluorescent lamp device connected to those terminals with. A parameter of the switched current is responsive to the signal at a control input of the control converter, for selectively dimming the resultant illumination produced by the lamp from a relatively maximal level. The control converter, in one embodiment, employs a regulating pulse width modulator control circuit and a resonant converter type output stage, prior art examples which are described in the above noted U.S. Pat. No. 4,933,605. The control converter thus can be of the pulse width modulated resonant converter type, and can produce the switch current with a duty cycle responsive to the signal at the control input. A further element of the electric circuit is a dimming control stage connected with the control input of the control converter and having a photoresponsive circuit element. The dimming control stage applies to the control input terminal a signal that is selectively responsive to the level of light incident on the photoresponsive circuit element. The fluorescent lamp operating circuit preferably operates with an adjustable optical occluder arranged in optical alignment with the photoresponsive circuit element, for selecting the signal produced at the control input for a given light condition and for thereby selecting the level of resultant illumination produced under a given light condition.

According to another feature of the invention, it provides an electrical direct current supply that operates in response to a rectified ac voltage received at a pair of input terminals and that has a semiconductor output switch stage. The output switch stage is connected for receiving the rectified ac voltage and has a control input terminal and operates to conduct during only a portion or portions of each cycle of the rectified ac voltage, depending for example on whether the rectified ac voltage is of the full-wave rectified type or of half-wave rectified type.

The output switch stage in a preferred practice includes a semiconductor switch connected to receive the rectified ac voltage across the conduction path there through. A first semiconductor threshold device is connected with the control input terminal for limiting the level of an assertive signal developed at that control input terminal. The first threshold device in a preferred embodiment is a zener diode.

The direct current supply further has a second semiconductor threshold stage connected receiving the rectified ac voltage and connected with the control input terminal. The threshold stage maintains the control input terminal at a non-assertive level during each cycle of the rectified ac voltage except when the level of the rectified ac voltage exceeds, with a selected polarity a threshold level of the second threshold stage. At those times, the second threshold stage applies an assertive signal to the control input terminal. In a preferred practice, the second threshold stage has a second zener diode connected with a further transistor switch. The second zener diode maintains the further transistor switch conductive only when the rectified ac voltage exceeds a level determined by the second zener diode. The electrical supply thus employs the second threshold stage to determine the relative level of the direct voltage it produces, and it employs the first threshold device to limit the level of the assertive signal applied to the output stage. In the embodiment described below, zener diodes provide the two thresholds, and a transistor switch is connected with an FET output transistor switch and maintains that output transistor switch normally non-conductive, except when the zener diode of the second threshold stage is conductive.

These and other features of the invention will be more fully appreciated with reference to the following detailed description which is to be read in conjunction with the attached drawings.

DESCRIPTION OF ILLUSTRATED EMBODIMENTS

The invention provides, in one aspect, a dimmable fluorescent lamp adapter having a single lamp-supporting housing. The dimming control circuit is contained within that housing, and the dimming control element is mounted on that housing and is manually accessible external to the housing. A fluorescent illumination element mounts on the adapter housing with electrical connection to the control circuit. The resultant unitary adapter structure installs on existing light fixtures and is controllable at the location of the lamp instead of at a remote control station.

Figure 1:
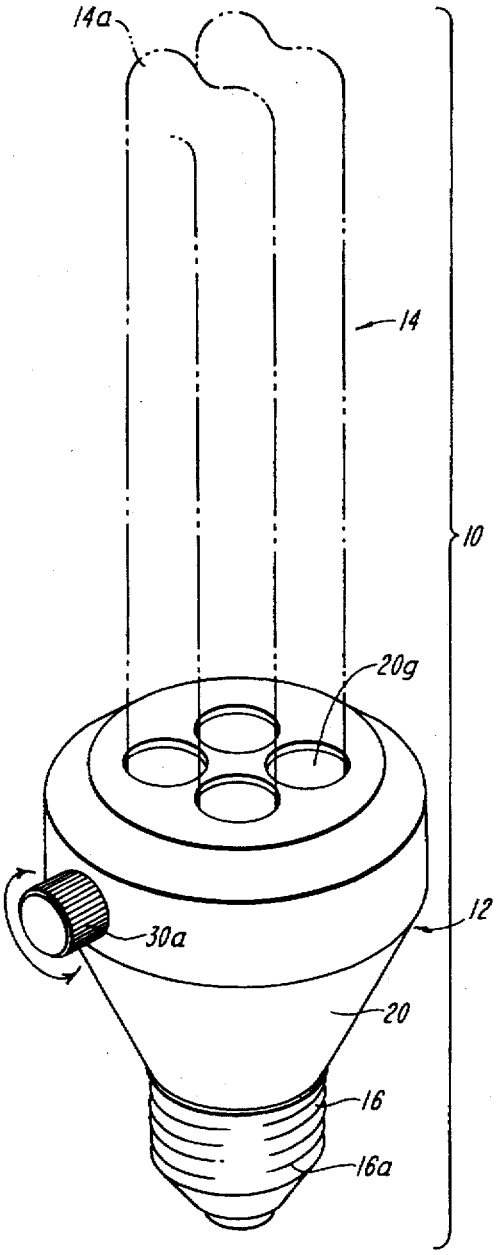
FIG. 1 is a perspective view of a dimmable lamp apparatus according to one embodiment of the invention.
Figure 2:
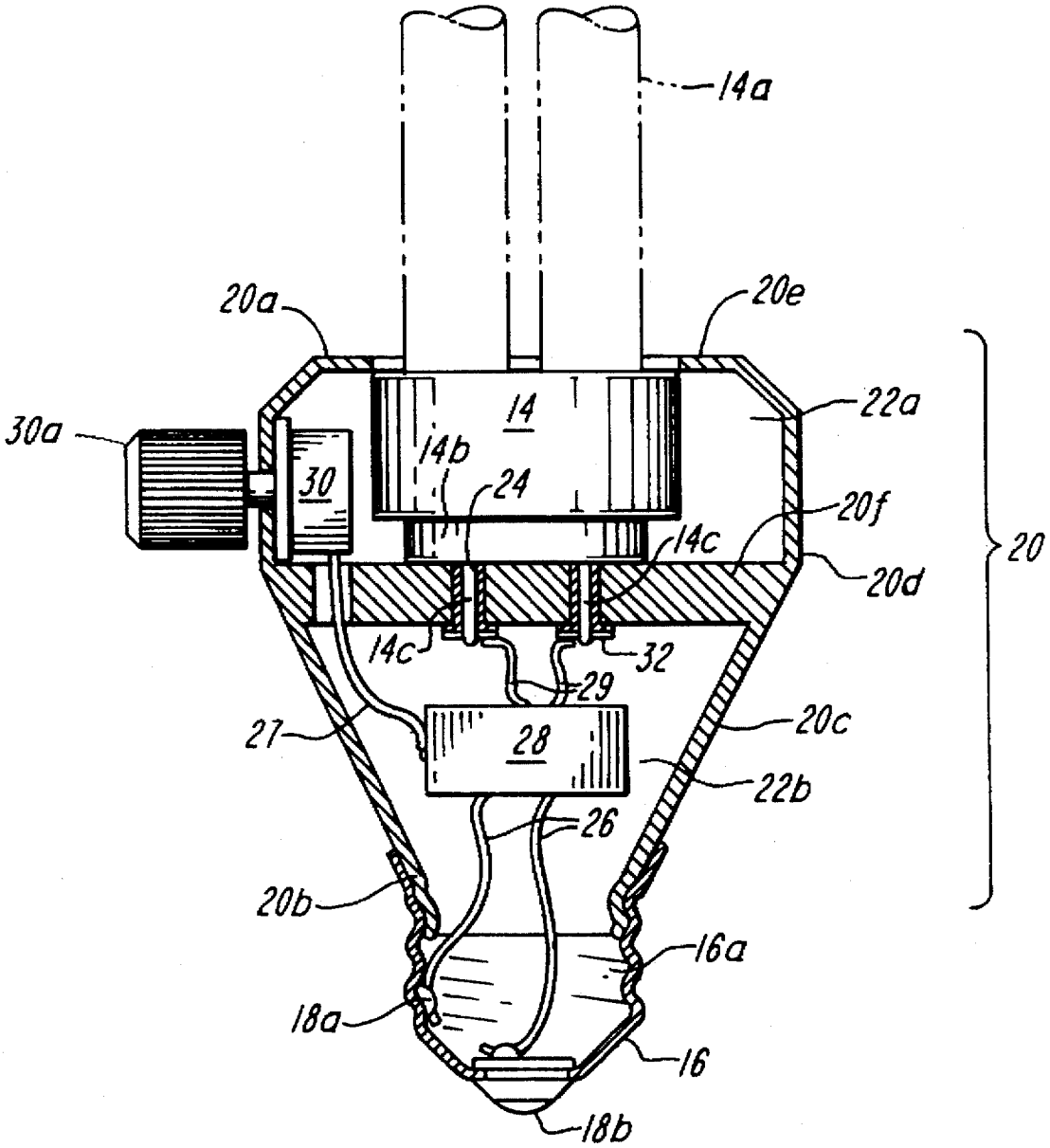
FIG. 2 is a schematic cross-sectional view of a dimmable lamp apparatus according to the embodiment shown in FIG. 1.

Referring more particularly to the drawings, FIGS. 1 and 2 show a dimmable lamp 10 having a lamp adapter 12 according to the invention and fitted with a fluorescent lamp element 14. The lamp adapter 12 has a conventional electrical socket base 16 which includes threads **16*a* for threaded engagement with a conventional electrical lamp socket. The electrical socket base typically includes two electrical conductors 18*a* and 18*b* arranged for electrical connection with corresponding conductors on the electrical lamp socket. As conventional, the electrical conductors 18*a* and 18*b* are located at the side and the bottom, respectively, of the socket base 16**.

The adapter 12 further includes an electrically insulative housing 20 having a top end **20*a* axially spaced from a bottom end 20*b*. The illustrated housing 20 has a generally overall conical or triangular shape which is narrow at the bottom end 20*b* and wider at the top end 20*a*. The housing includes funnel-like portion 20*c* above the bottom end 20*b* and below a tubular portion 20*d*, and the housing can have any practical cross-sectional shape, such as, for example, circular, ellipsoid, rectangular or triangular. The illustrated tubular portion 20*d* has a cylindrical wall and is bounded at the top by flat wall 20*e* and at the bottom by an interior panel 20*f*. The housing 20 thus bounds a hollow interior space 22 partitioned into an upper interior space 22*a* and a lower interior space 22*b* by the interior panel 20*f*, which spans the interior space 22 transverse to the longitudinal axis of the housing. The socket base 16 is secured to the housing 20 at the bottom end 20*b* of the housing to form the bottom of the adapter 12**.

In an alternative embodiment of the present invention, the dimmable lamp apparatus includes a removable and replaceable fluorescent illumination element 14. The illumination element removably and replaceably plugs into a socket-like lamp supporting element comprising interior panel 20*f* with socket connectors 32. The base portion 14*b* of the illumination element 14 seats on the top face of panel 20*f* and fits within openings 20*g* in the top wall 20*e*, as shown in FIGS. 1 and 2. Electrical contacts 14*c* extend through the openings 24 in the panel 20*f* to removably and replaceably plug into conductive socket connectors 32, thereby forming electrical connection between the illumination element 14 and the adapter 12.

A controllable circuit 28 is within the housing 20, illustratively in the lower interior space 22*b*. Input electrical conductors 26 of the control circuit 28 connect respectively to the electrical conductors 18*a* and 18*b* of the base. The controllable circuit 28 applies an adjustable variable operating electrical excitation to the illumination element 14 in response to a controllable electrical signal. One such controllable circuit is disclosed in U.S. Pat. No. 5,245,253 to Quazi et al. and U.S. Pat. No. 4,933,605 to Quazi et al., each herein incorporated by reference into this application.

With further reference to FIGS. 1 and 2, the adapter 10 includes an electrical adjustment element 30, such as a variable resistor, which has a manually adjustable knob element 30*a*. The adjustment element 30, which electrically connects with the controllable circuit 28 via conductor 27, produces a controllable electrical signal in response to adjustment of the position of the adjustment element 30. The adjustment element 30 is preferably manually accessible on the exterior of the tubular portion 20*d* of the housing 20. The illustrated adjustment element 30*a* in FIG. 1 and 2 is a knob rotatable about an axis transverse to the longitudinal housing axis. A preferred electrical adjustment element 30 includes, for example, a plurality of gears within the housing 20 which engage with the shaft of the electrical adjustment element and with the shaft of a variable resistor.

Output conductors 29 from the controllable circuit 28 electrically connect to the electrical contacts 14*c* of the fluorescent illumination element 14 via the socket connections 32.

The lamp apparatus thus described provides dimmable and brightenable fluorescent light with manual adjustment of the knob element 30 on the housing of the lamp. With electrical connection of the lamp to an electrical power source, the illumination element 14 provides variable fluorescent light output according to the position of the adjustable knob element 30, which is electrically connected to the dimming circuit control 28.

Figure 3:
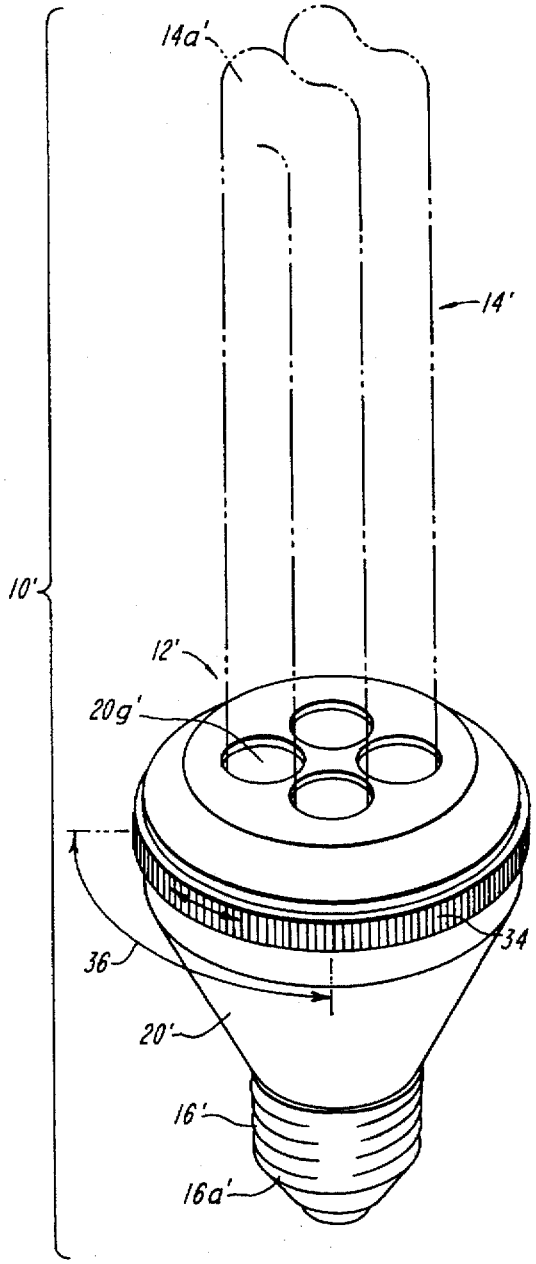
FIG. 3 is a perspective view of a dimmable lamp apparatus according to another embodiment of the invention.

FIG. 3 shows another dimmable fluorescent lamp 10' according to the invention and having an adapter 12' and a fluorescent illumination element 14'. Elements of the lamp 10' which are common to the elements of the lamp 10 of FIGS. 1 and 2 are designated with like reference numerals plus a superscript prime. The adapter 12' includes an electrically insulative housing 20' which is substantially similar to the housing 20 illustrated in the embodiment of FIGS. 1 and 2. The housing 20' includes a controllable circuit element 28 and an electrical adjustment element 30 as illustrated in FIGS. 1 and 2. The lamp 10' of FIG. 3 operates with an adjustment element and a controllable circuit like the element 30 and the circuit 28 of FIGS. 1 and 2. However, the adapter 12' of FIG. 3 controls the lamp illumination with a dimmer control 34 that extends about at least part of an outer circumference of the housing 20'. The dimmer control 34 is rotatably movable relative to the housing 20' about the longitudinal axis, as indicated with an arrow 36 extending along the direction of the rotational movement. The dimmer control is linked to the adjustment element 30 within the housing 20'. The illustrated dimmer control 34 encircles the housing tubular portion 20*d'* to be accessible from any direction for manual adjustment.

The upper interior space 22*a* of the housing 20', which is bounded below by the panel 20*f*, above by the top flat wall 20*e* and at the sides by tubular portion 20*d*, mountingly receives and supports the fluorescent illumination element 14'. The fluorescent illumination element 14' has one or more illumination tubes 14*a'*, a base portion 14*b'* and electrical contacts 14*c'* (not shown). The base portion 14*b'* seats within the housing 20' on the top face of the panel 20*f* with electrical contacts 14*c'* extending through the panel for fixed electrical connection below. Illumination tubes 14*a'* extend through openings 20*g* in the top wall 20*e* of the housing.

Operation of the lamp 10' is similar to the operation of the lamp 10 previously described. Dimmer control 34 electrically connects to control circuit 28, and manual circumferential movement of the dimmer control 34 varies the light output of the lamp to the desired brightness.

Figure 4:
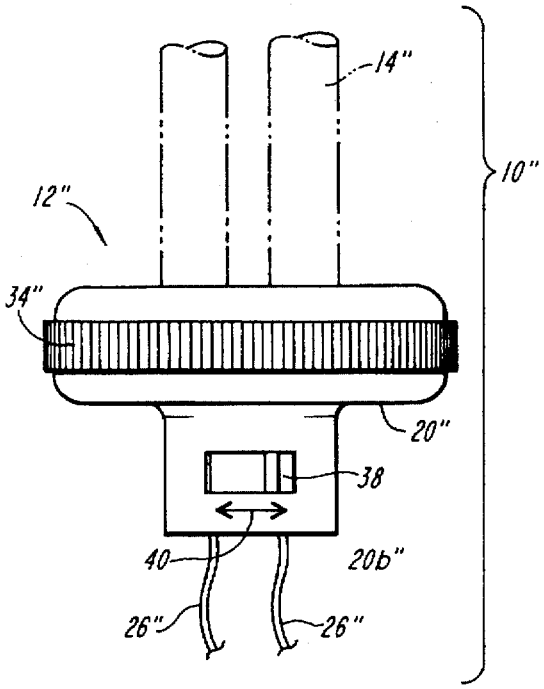
FIG. 4 is perspective view of a dimmable lamp apparatus according to still another embodiment of the invention.

FIG. 4 shows another dimmable fluorescent lamp apparatus 10" according to the invention and having an adapter 12" and a fluorescent illumination element 14". Elements of the lamp 10" which are common to the elements of the lamp 10' of FIG. 3 are designated with like reference numerals plus a superscript double prime. The adapter 12" includes an electrically insulative housing 20" which is substantially similar to the housing 20' illustrated in FIG. 3. The illustrated housing 20" includes a controllable electrical circuit element 28" (not shown) and an dimmer control 34" as illustrated in FIG. 3, and operates with an adjustdimmer control and a controllable electrical circuit like the element 34 and circuit 28 of FIG. 3. Additionally, the adapter 12" includes a switch 38 manually positionable and manually accessible external to the housing 20". The illustrated switch 38 is movable between discrete positions relative to the housing 20", as indicated with an arrow 40. The switch 38 is connected with the control circuit 28" within the housing 20" and links with a source of electrical power through electrical conductors 26", which can be wired directly to an electrical fixture for permanent installation of the lamp.

Placement of the switch 38 in one position enables current to flow from the electrical power source through the conductors 26" to the control circuit 28", thereby energizing the illumination element 14" and commencing operation of the lamp. Manual adjustment of the dimmer control 34" varies the light output as previously described. Placement of the switch 38 in another position terminates current flow to the control circuit, thereby ceasing lamp operation.

Figure 5:
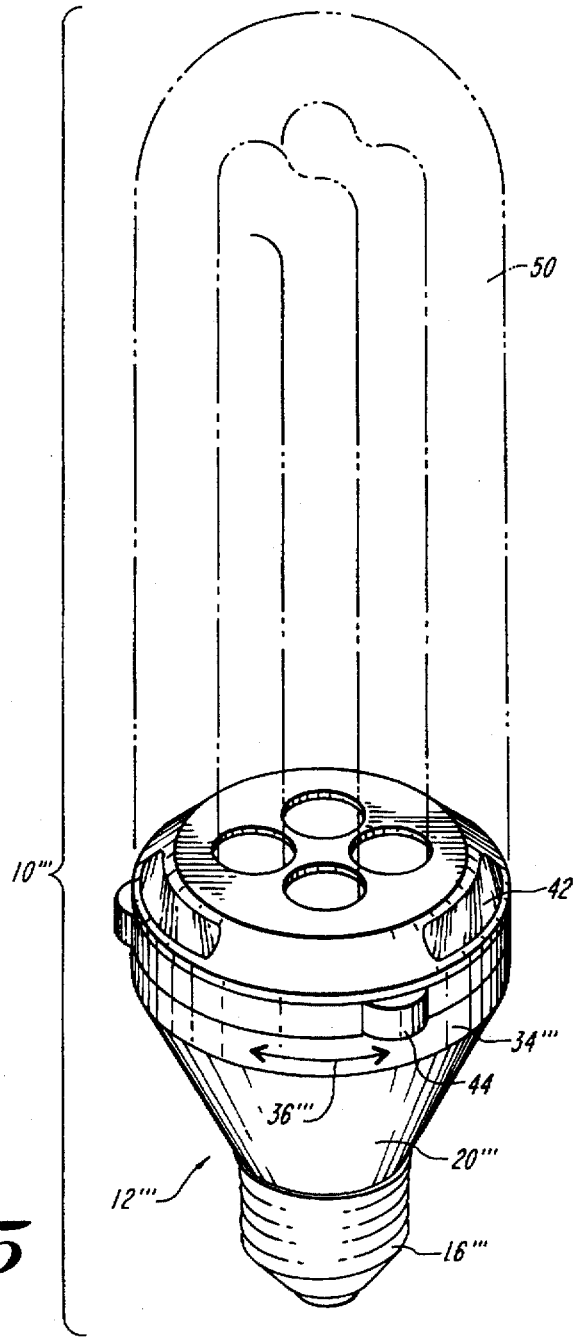
FIG. 5 is a perspective view of a dimmable lamp apparatus according to still another embodiment of the invention.
Figure 6:
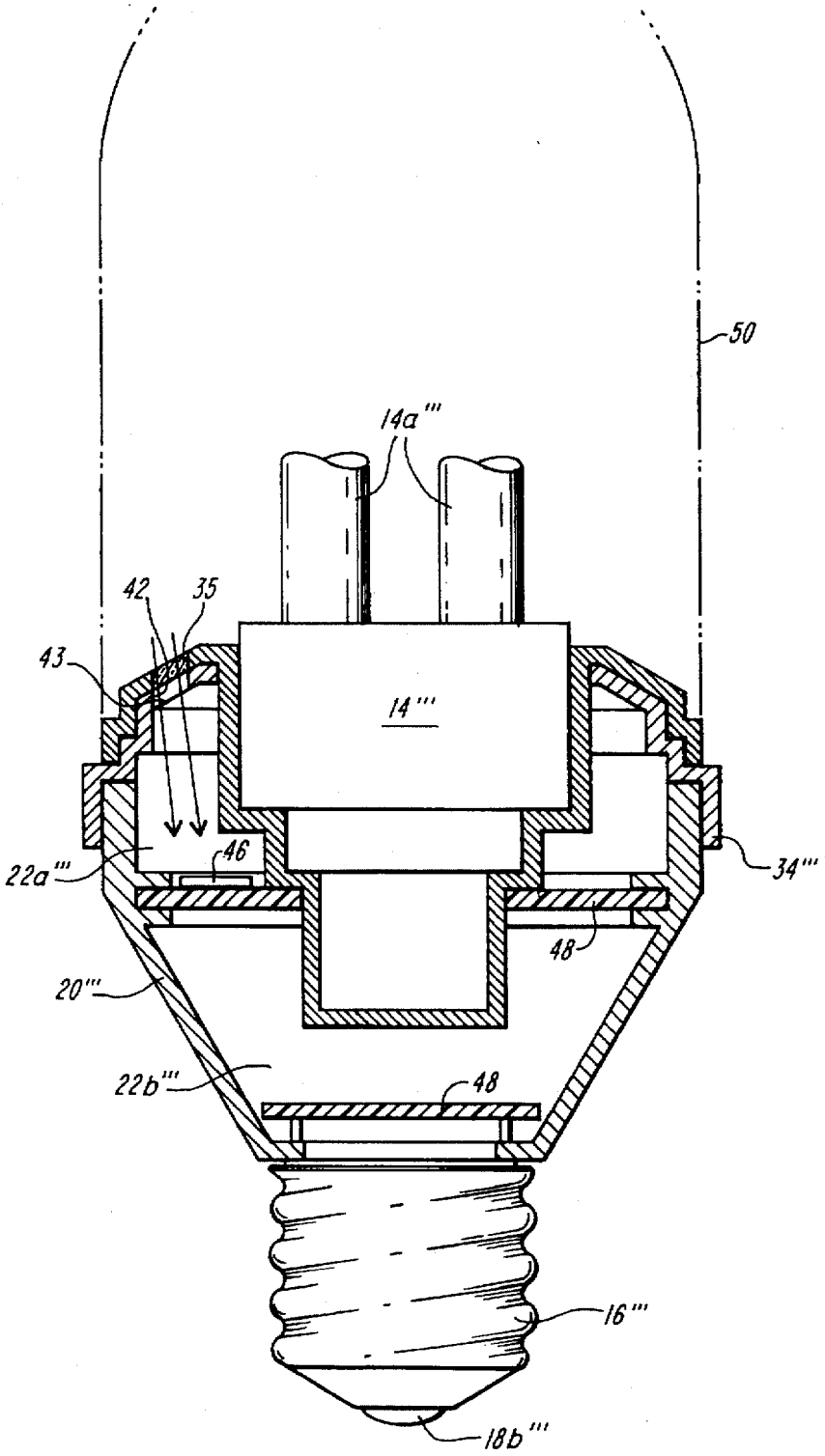
FIG. 6 is a partial sectional view of the dimmable lamp apparatus shown in FIG. 5.

FIGS. 5 and 6 shows another dimmable fluorescent lamp apparatus 10'" according to the invention and having an adapter 12'" and a fluorescent illumination element 14'". Elements of the lamp 10'" which are common to the elements of the lamp 10 of FIGS. 1 and 2 are designated with like reference numerals with a superscript triple prime. The adapter 12'" includes an electrically insulative housing 20'" which is substantially similar to the housing 20 illustrated in the embodiment of FIGS. 1 and 2. However, in this embodiment the housing 20'" includes one or more apertures 42 to permit entry of light from ambient surroundings, including other illumination sources and from operation of the fluorescent illumination element 14'", into the housing. As shown in FIG. 6, the housing 20'" further includes a controllable circuit element 28'" electrically connected to the conductors 18a''' and 18b''' in the base 16''' and to the electrical contacts of the fluorescent illumination element 14'''. The controllable circuit element 28''' includes one or more light sensing elements 46 which can be mounted on a circuit board 48, as shown in FIG. 6. The controllable circuit element 28''' is preferably located in the lower interior space 22b''' of the housing 20''' and can also be mounted on a circuit board 48.

The housing 20''' preferably includes a plurality of apertures 42 which are preferably positioned at or near the top end 20a''' of the housing 20''' and arranged around the periphery of the housing, as shown in FIG. 5. The apertures 42 can also be located in the housing tubular portion 20d'''. The number and location of the light sensing elements 46 within the housing determines, at least in part, the number and placement of the apertures 42 in the housing 20''', as shown in FIG. 6.

The apertures 42 preferably have protective panes 43 which protect the components inside the adapter housing 20''' from the environment outside the lamp apparatus 10''', such as moisture and dust. The protective panes 43 are preferably made of a thin, optically transparent or translucent material, such as glass or plastic, although other types of optical filters can be used. It may be desirable, for example, to use a tinted plastic film as the protective pane 43 to darken or otherwise filter the light sensed by the light sensing elements 46 in the adapter. The protective panes 43 can be located adjacent to and above and/or below the apertures 42 and can be affixed to the housing 20''' according to methods well-known in the art.

The light sensing element 46 is preferably a photosensitive control element, such as, for example, a photocell or a phototransistor. Preferably the number of light sensing elements 46 equals the number of apertures 42, and it is further preferred to arrange the light sensing elements 46 to be directly below the apertures 42 so that the light sensing elements 46 receive light entering the housing through the apertures 42. In a preferred embodiment, the apparatus 10''' includes a plurality of light sensing elements 46 placed around the periphery of the adapter 12''' directly beneath the apertures 42, as shown in FIG. 6.

The housing 20''' further includes an optical adjustment element 34''' which is manually accessible on the outside of the adapter 12''' and is movable relative to the housing about the longitudinal axis, as indicated with an arrow 36''' extending along the direction of rotational movement. The optical adjustment element 34''' is illustrated as a ring member with manually accessible knobs or protuberances 44. The optical adjustment element 34''' can further includes one or more aperture occluders 35 which block passage of light to the light sensing elements 46 within the housing 20'''. The aperture occluders 35 can be disposed within the housing 20''', as shown in FIG. 6, or they can be located outside of the housing, or they can be located on the ring member itself. Preferably, the aperture occluders 35 are integrally formed with the ring member and extend axially from the ring member to shield the apertures from incoming light. The integrally formed aperture occluders preferably extend axially from the ring member between the aperture 42 and the light sensing element 46, as shown in FIG. 6. Movement of the optical adjustment element 34''' around the periphery of the housing 20''' causes movement of the aperture occluder 35 across the aperture 42, as shown in FIG. 5.

The lamp apparatus 10''' shown in FIG. 5 can further include an optically transparent or translucent dome 50 which fits snugly with the adapter 12''' and protects the fluorescent illumination elements 14''' and the apertures 42 from dirt, moisture, shock and the like. The dome 50 can be made of, for example, glass or plastic. If the apertures 42 are located on the top end 20a''' of the housing, the dome 50 can be used to cover and protect the entire top portion of the housing 20''', thereby possibly eliminating the need for separate protective panes 43 in the apertures 42. However, if the apertures 42 are located elsewhere on the housing, protective panes 43 are preferably used to isolate the components within the adapter housing 20''' from the environment outside the adapter.

Operation of the lamp 10''' is similar to the operation of the lamp 10' previously described. Manual positioning of the optical adjustment element 34''' determines the position of the aperture occluders 35 with respect to the apertures 42. The control circuit 28''' can be designed to turn the lamp on in response to either an absence of light or the presence of light at the light sensing elements 46. In one embodiment of the invention, when the aperture occluders 35 completely cover the apertures 42, no ambient light nor light from the fluorescent illumination element 14''' can enter the housing and impinge on the light sensing element 46. Thus, there is no electrical signal generated by the light sensing element 46 to the controllable electrical circuit 28''', and the fluorescent lamp control circuitry 28 turns the lamp on. When the aperture occluders 35 are adjusted to partially block the apertures 42, some ambient light and/or light from the fluorescent illumination element impinges on the light sensing element 46. A proportional electrical signal is thus generated by the light sensing element, thus driving the lamp control circuitry 28''' to dim the lamp. When the aperture occluders are positioned so as not to block any portion of the apertures 42, any ambient light and/or light from the fluorescent illumination element can enter the aperture and impinge on the light sensing element 46 within the adapter. A maximum electrical signal is generated by the light sensing element 46, thus causing the lamp control circuitry 28''' to turn the lamp off.

In an alternative embodiment, complete blockage of the apertures 42 by the aperture occluders 35 can cause the control circuit 28''' to turn the lamp off. Conversely, positioning the aperture occluders 35 so that they do not block the apertures can cause the control circuit 28''' to turn the lamp on.

Dimming and brightening of the lamp are thus easily and conveniently achieved by manual positioning of the optical adjustment element 34''' on the outside of the lamp.

Figure 7:
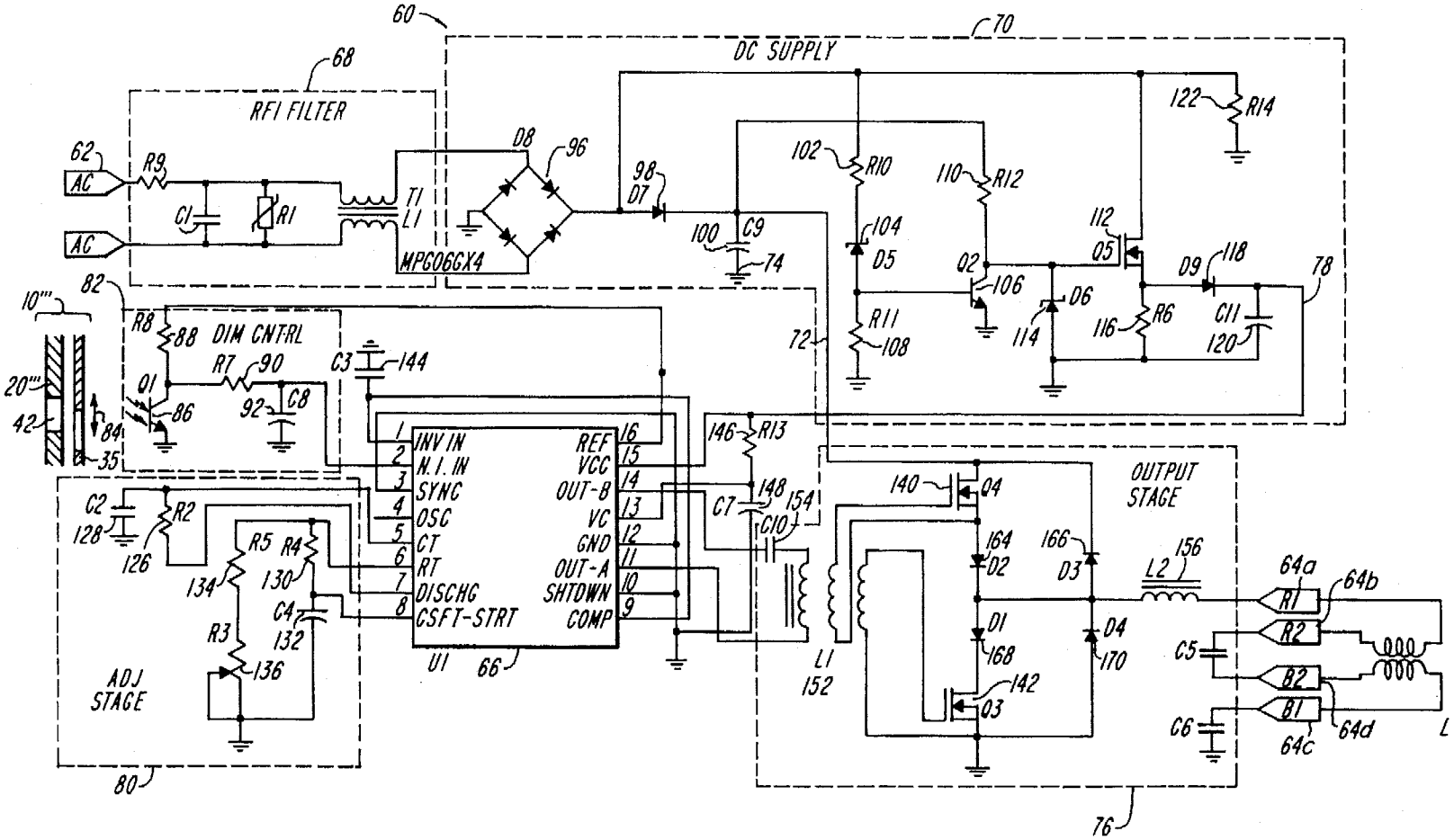
FIG. 7 is an electrical schematic circuit diagram of a dimmable lamp driver embodying features of the invention and for use with the lamp of FIGS. 5 and 6.

With reference to FIG. 7, a lamp driver 60 for use with the lamp apparatus 10''' of FIG. 5 is powered by conventional 120-volt ac line voltage at a pair of ac input terminals 62, 62. The lamp driver applies to a fluorescent lamp L, such as the lamp 14''', connected to output terminals 64a, 64b, 64c and 64d, bi-directional current pulses having a duty cycle that is selectively variable for attaining a desired level of lamp brightness.

Figure 8:
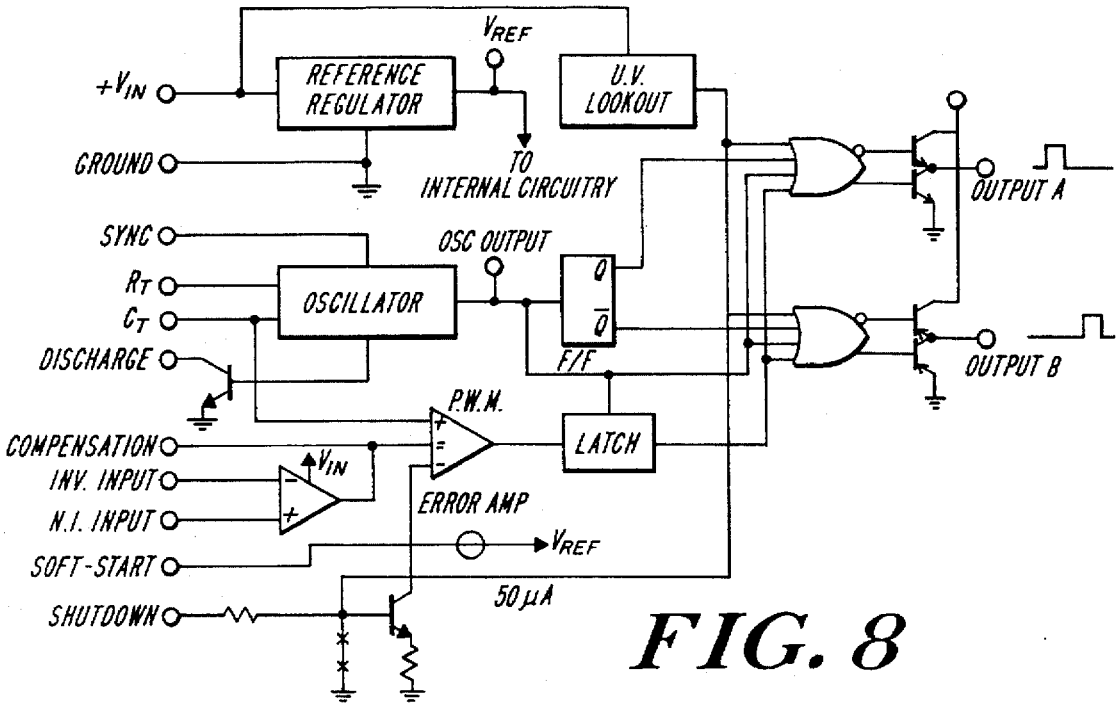
FIG. 8 is a partial electrical schematic diagram of the control circuit for the driver of FIG. 7.

The illustrated lamp driver 60 employs a regulating pulse width modulator control circuit 66 commercially available as an integrated circuit and marketed by General Signal and others under the designation 2525A. FIG. 8 shows a partial electrical diagram of the control circuit.

The illustrated lamp driver 60 has an RFI (radio frequency interference) filter 68 that blocks the transfer of unwanted electrical perturbations between the lamp driver and the ac line voltage connected to the input terminals 62. In particular, the filter isolates the ac line from electrical interference produced by the driver. The illustrated RFI filter 68 has a conventional arrangement, in succession, of an input series resistor, a parallel capacitor, a parallel varistor, and coupled series inductors. A dc voltage supply 70 produces, in response to the filtered line voltage, a high level dc voltage and a low level dc voltage. The high level dc voltage is developed between a line 72 and a common return or ground 74 and is applied to an output stage 76. The low level dc voltage is developed between the return 74 and a line 78, and is applied to the VCC pin of the control circuit 66 to provide operating power for that circuit.

An adjustment stage 82, which provides selected resistor and capacitor elements, connects to the control circuit 66 CT pin, RT pin, discharge pin, and soft start pin.

A dimming control stage 82 connects to the non-inverting pin of the control circuit 66 and applies a selected dc voltage for attaining the desired dimming level, i.e. for controlling the control circuit 66 to produce the selected level of lamp illumination.

More particularly, with continued reference to FIG. 7, the dimming control stage 82 of the illustrated lamp driver 60 has a phototransistor 86 in series between the ground return and a voltage dropping resistor 88 connected to the REF pin of the control circuit 66, where a de voltage in the order of five volts is present. A resistor 90 is in series between the interconnection of the phototransistor 86 and the resistor 88 and the non-inverting pin of the control circuit 66. A smoothing capacitor 92 is connected between the non-inverting pin and the ground return. (The phototransistor 86 in one embodiment of the light sensing element 46 of FIG. 6.)

The light aperture 42 in the housing 20''' of the lamp apparatus 10''' FIG. 5, and the aperture occluder 35 of the lamp, which is movable as indicated with the arrow 84 to selectively block the light path through the aperture, are in optical alignment with the optically sensitive input surface of the phototransistor 86. Accordingly, the transistor 86 conduction is responsive to both the intensity or brightness of light incident on the aperture 42 and to the position of the occluder 35. The phototransistor 86 thus forms a light-responsive resistance arranged essentially in a voltage divider configuration with the resistor 88 to apply a light responsive voltage to the non-inverting pin of the control circuit 66, by way of the resistor 90. The resistor 90 and the capacitor 92 form a filter that prevents high frequency disturbances, as may be present in the light incident on the phototransistor from affecting the control circuit 66. These high frequency fluctuations could otherwise cause unwanted flicker-like adjustments of the brightness of the fluorescent lamp L.

The dimming control stage applies maximum dc voltage, determined by the voltage at the REF pin, to the non-inverting pin when the light incident on the phototransistor has minimal brightness, i.e. in a dark condition. This, in turn, operates the control circuit 66 to apply to the output stage 76 switching signals that have maximal duty cycle, for thereby driving the lamp L for maximal illumination. As the level of light incident on the phototransistor increases—due to an increase in the light on the aperture 42 or to opening of the occluder 35, or to a combination of both factors—the phototransistor conduction increases correspondingly. This decreases the voltage that the stage 82 applies to the control circuit 66. In response, the control circuit drives the output stage with switching signals having a correspondingly shorter duty cycle, i.e. the switching signals are assertive for correspondingly shorter times. The output stage then drives the lamp L less hard, to dim the illumination.

The illustrated dc supply 70 has a full-wave rectifier 96 that receives the filtered line voltage and that produces a full wave rectified voltage between the anode of an isolation diode 98 and the ground return. The cathode of the diode 98 is connected to a parallel filter capacitor 100.

The illustrated dc supply 70 further has a resistor 102 in series with a zener diode 104, the anode of which is connected to the base of a semiconductor switch illustrated as a transistor 106. The other lead of resistor 102 is connected to the high voltage at the anode of the diode 98. A resistor 108 is connected from the transistor base to the common return. A resistor 110 is connected between the collector of transistor 106 and the anode of the diode 98.

A further semiconductor switch illustrated as a FET transistor 112 has the gate connected to the collector of the transistor 106. A zener diode 114 is connected between the gate and the return. The drain of transistor switch 112 is connected to the high voltage from the full wave rectifier, and a resistor 116 is connected between the substrate and the source of the transistor 112 and the return. An isolating diode 118 is connected between the transistor 112 source and the supply output, which is the line 78. A filter capacitor 120 is connected between the low-voltage supply output and the return. A further resistor 122 is connected between the high voltage output from the full wave rectifier and the return.

The zener diode 104 conducts during each half cycle of the rectified voltage output from the full wave rectifier 96 when that voltage exceeds the zener breakdown voltage. The resultant zener-diode conduction, during a portion of each half cycle, biases the transistor 106 to conduct during essentially the same portion of each half cycle. This conduction drives the collector of transistor 106 essentially to the potential of the grounded emitter. The transistor 106 collector rises to the voltage across the capacitor 100 during the remaining time of each half-cycle when the transistor 106 is non-conducting. The zener diode 114 limits the positive voltage to which the transistor 106 collector rises when that transistor is non-conductive and thereby limits the positive voltage applied to the gate of the field effect transistor 112. That transistor conducts during the portion of each half cycle when the transistor 106 is non-conductive. The conduction through the switching transistor 112 charges the output capacitor 120. The conduction voltage of the zener diode 104 thus determines the conduction time, in each half cycle of the ac line voltage, of the FET switch 112. It thereby determines the charging time, in each half cycle, of the output capacitor 120 of the supply 70. The de voltage the supply 70 develops on the output line 78 is thus in part determined by, and hence can be selected by, the selection of the zener diode 104 reverse conduction voltage.

Figure 9:
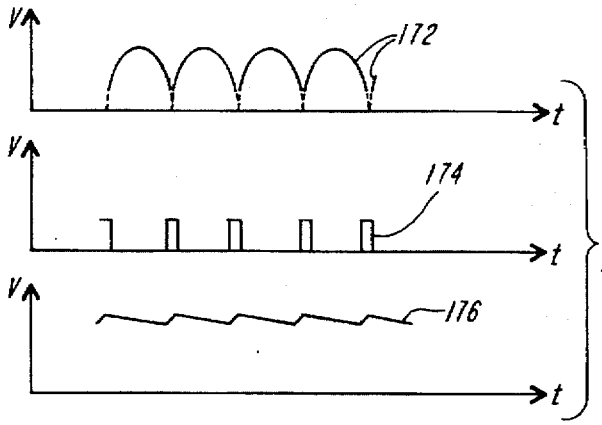
FIG. 9 shows timing waveforms of the operation of the power supply stage.

With reference to FIG. 9, waveform 172 shows, with the broken and solid lines, a theoretical representation of the full wave rectified voltage at the anode of the diode 98, i.e. at the output of the full wave rectifier 96. Waveform 172 further shows, with the solid line, the intervals of conduction of the zener diode 104 and the correspondingly intervals of conduction of the transistor switch 106. Waveform 174 illustrates the corresponding relative voltage at the collector of switching transistor 106, as limited by the conduction of the zener diode 114. This waveform 174 also represents the relative time of conduction of the FET transistor switch 112. Waveform 176 illustrates the corresponding voltage across the output capacitor 120, with the vertical scale enlarged for clarification.

The power supply 70 thus generates a selected relatively low direct current voltage from the alternating line voltage, without use of a line frequency transformer and with a circuit that has relatively few components and correspondingly is low in size, weight and cost. Moreover, the supply output voltage remains relatively constant over a range of output load currents. This is because the output voltage is determined by the zener diode 104, whereas the output current is determined in large part by the output elements of the supply stage including the FET transistor switch 112, the diode 118, and the output capacitor 120. Moreover, the dc supply 70 operates with relatively high electrical efficiency, in that it operates with minimal use of dissipative circuit elements. Instead, it operates essentially with non-dissipative semiconductor elements.

With continued reference to the lamp driver of FIG. 7, the adjustment stage 80 provides adjustment and control for an oscillator that is part of the control circuit 66. The illustrated stage 80 includes a resistor 126 connected between the CT pin and the discharge pin of the control circuit. A capacitor 128 is connected to the return from the CT pin. A resistor 130 is connected between the RT pin and the soft start pin of the control circuit 66, and a capacitor 132 is connected to the return from the soft start pin. In addition, the series combination of a resistor 134 and an adjustable resistor 136, which together form an adjustable resistor having a minimum value determined by the resistor 134, is connected between the RT pin and the return.

The values of the capacitor 128 and of the resistors 134 and 136 control the frequency of the output –A and output –B signals from the control circuit 66, which in turn drive the output stage switches, illustrated as FET transistors 140 and 142. Preferably, the frequency of the control circuit output signals that drive the output stage transistor switches 140, 142 is the same as the series resonant frequency of the resonant converter in the output stage 76, as described below. With this resonant arrangement, the control circuit drives the transistor switches 140 and 142 with substantially sinusoidal signals. This operation is desired to attain current switching by the transistor switches 140 and 142 at near zero voltage levels, to diminish the level of RFI produced during driver operation, and to attain electrically efficient operation The frequency of the control circuit output signals is preferably above 20 kilohertz to minimimize hum, other noise, and light flickering.

The illustrated lamp driver 60 has a capacitor 144 connected to the common return from both the inverting input pin and the complement pin of the control circuit 66. This capacitor operates with an operational amplifier that is part of the control circuit 66 to attain a selected unity gain, without oscillation. As further shown, the SYNC pin of the control circuit is connected to the ground pin, as is the shut down pin, all of which are connected to the lamp driver return path.

Operating power for the control circuit 66is applied to the VCC pin from the line 78 output from the de supply 70. The output stages of the control circuit are powered from the supply 70 at the VC pin, as shown in FIG. 8, through a decoupling circuit (FIG. 7) formed by a series resistor 146 and a shunt capacitor 148.

The output stage of the lamp driver 60 is a switched resonant converter that has a transformer 152, the primary winding of which is connected to the output A pin and output B pin of the control circuit 66. A dc blocking capacitor 154 is in series between the primary winding and the output B pin, as shown.

The transformer 152 has two secondary windings arranged with relatively opposite polarity, as indicated by the dots, and each of which is coupled between the source and the gate of a different one of the two FET transistor switches 140 and 142 in a manner to drive the switches to conduction alternately.

The high voltage developed in the dc supply 70 across the capacitor 100 is applied to the drain of one transistor switch 140, and the source of the other transistor switch 142 is connected to the return, so that the direct voltage across the supply capacitor 100 is applied across the series connected switch transistors 140 and 142.

An inductor 156 is in series between the output from the two switch transistors and one output terminal 64*a*. A series resonating capacitor 158 is connected between the output terminals 64*b* and 64*d*, and a dc blocking capacitor 160 is connected between the output terminal 64*c* and the return. The capacitor 158 is selected to be resonant with the inductor 156 at the desired frequency at which the output A and output B signals switch the transistors 140 and 142.

The lamp driver 60 output terminals are illustrated for connection with a fluorescent lamp L as shown at the right side of FIG. 7. That is, one filament of the lamp is connected between the output terminals 64*a* and 64*b*, and the second filament is connected between the output terminals 64*c* and 64*d*.

The illustrated output stage 76 further employs a pair of diodes connected with each FET transistor switch 140 and 142. In particular, a diode 164 is connected between the transistor 140 source and the inductor 156 for forward conduction with the conducting transistor 140. A further diode 166 is connected from the inductor to the drain of the transistor 140 with opposite polarity from the diode 164. A further pair of diodes 168 and 170 is similarly connected with the other switching transistor 142 and the inductor 156. The purpose of these diodes 164, 166, 168 and 170, termed high speed diodes, is to isolate the parasitic diodes inherent in the FET switches 140 and 142. The added diodes 164–170 prevent back EMF, produced by switching the inductor 156 current, from causing conduction of the parasitic diodes.

The lamp driver 60 of FIG. 6 produces the output A and output B signals from the control circuit 66 as a succession of unipolar squarewaves with a frequency, referred to as an oscillator frequency, determined by the selection of the resistor and capacitor components of the adjustment stage 80 as discussed above and as is conventional and known for the type 2525A control circuit. The oscillator frequency preferably is in excess of 20 kilohertz, and a value in the order of 30 kilohertz is typical. The output A signal in the illustrated embodiment has one pulse per cycle which occurs in the first half of each cycle, and the output B signal likewise has one pulse per cycle and occurring in the second half cycle. The transformer 152 couples each output signal to the gate of a different one of the two FET transistor switches 140 and 142. Each transistor switch is driven to conduction accordingly in alternate half cycles of the oscillator frequency. Each pulse from the control circuit thus drives one transistor switch 140, 142 to conduct current from the supply 70 and apply it, through the inductor 156 and the series resonant capacitor 158, to a fluorescent lamp connected to the driver output terminals 64.

The duration of each output A and output B pulse is responsive to the level of the dc voltage, which is a dimming control voltage, which the dimming control stage 82 applies to the non-inverting pin of the control circuit 66. A relatively large dimming control voltage, which is responsive to relatively low light, i.e. a dark condition, incident on the phototransistor 86, actuates the control circuit to produce relatively long output pulses, i.e. output pulses having a relatively large duty cycle. These output pulses produce relatively long times of conduction of each FET transistor switch 140 and 142 during each oscillator cycle and correspondingly drive current to the lamp L during a relatively large part of each half cycle of the oscillator frequency. Correspondingly, a smaller dimming control voltage attains dimming of the light by actuating the control circuit to produce shorter output pulses. In response, the FET transistor switches conduct for shorter intervals of each cycle of the oscillator frequency and apply current to the lamp L for a shorter portion of each oscillator frequency cycle.

The further operation of the driver output stage 76 is known to those skilled in the art, as discussed, for example, in U.S. Pat. No. 4,933,605, the disclosure of which is incorporated herein by this reference.

Figure 10:
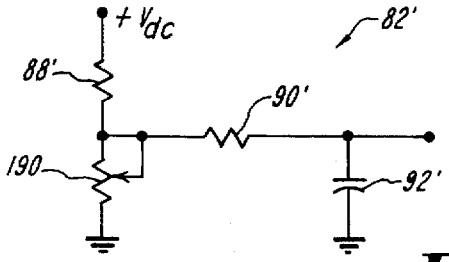
FIG. 10 is an electrical schematic diagram of an alternative dimming control stage for the lamp driver of FIG. 7.

The lamp driver 60 of FIG. 7 can be used with a dimmable fluorescent lamp controlled not with a phototransistor as in FIG. 7, but rather with an adjustable resistor, such as a rheostat or potentiometer, as shown with the dimmable lamp 10 of FIG. 1 and 2, by replacing the phototransistor 86 in the dimming control stage 82 with the adjustable resistor. FIG. 10 shows such a modified dimming control stage 82' for connection with the non-inverting input of the control circuit 66 of FIG. 7. The modified dimming control stage 82' as illustrated has a resistor 88', a resistor 90', and a capacitor 92', each corresponding to the similarly numbered element in the stage 82 of FIG. 6. In addition, the stage 82' has a variable resistor 190 connected between the return path and the interconnections of the resistors 88' and 90'. The wiper or other control element of the variable resistor 190 is coupled with the manually controllable element of the dimmable lamp, e.g. with knob element 30*a* of FIG. 1 or the dimmer control 34 of FIG. 3.

Other alterations to the above-described embodiments will be readily apparent to those ordinarily skilled in the art and are intended to be embraced within the spirit and scope of the invention. That is, the above description is intended to be illustrative rather than limiting. The invention is to be defined, therefore, not by the preceding description but by the claims that follow.

We claim:

1. Dimmable fluorescent lamp apparatus comprising an electrical socket base for threading into an electrical lamp socket and having electrical conductors arranged for electrical connection with corresponding conductors of the electrical lamp socket, an electrically insulative housing having a top end axially spaced from a bottom end and mounting said base at said bottom end, said housing having lamp supporting means at said top end for mountingly receiving a fluorescent illumination element having electrical contacts and having a tubular portion extending between said base at said bottom end and said supporting means at said top end, said housing having one or more apertures to permit light resulting from ambient conditions and from illumination of said fluorescent lamp element and from other illumination sources to enter said housing through said apertures, controllable electrical circuit means disposed within said housing and connected with the electrical conductors of said base for receiving electrical power and having output conductors for electrical connection to the contacts of a fluorescent illumination element mountingly received in said supporting means and applying an adjustable variable operating electrical excitation to a fluorescent illumination element in response to a controllable electrical signal, light sensing means disposed within said housing and in electrical connection with said controllable electrical circuit means, and optical adjustment means for controlling the entry of said light through said apertures, thereby controlling impingement of said light onto said light sensing means for producing said controllable signal in response to adjustable positioning of said optical adjustment means, said optical adjustment means being manually accessible externally of said housing tubular portion.

2. Dimmable fluorescent lamp apparatus according to claim 1 wherein said apertures are disposed in said top end of said housing.

3. Dimmable fluorescent lamp apparatus according to claim 1 wherein said apertures are disposed in said housing tubular portion.

4. Dimmable fluorescent lamp apparatus according to claim 1 wherein said light sensing means are positioned within said housing so as to receive ambient light and light resulting from illumination of said fluorescent lamp element and other illumination sources through said apertures.

5. Dimmable fluorescent lamp apparatus according to claim 1 wherein said apertures hard protective panes.

6. Dimmable fluorescent lamp apparatus according to claim 5 wherein said protective panes are made of an optically transparent material.

7. Dimmable fluorescent lamp apparatus comprising an electrical socket base for threading into an electrical lamp socket and having electrical conductors arranged for electrical connection with corresponding conductors of the electrical lamp socket, an electrically insulative housing having a top end axially spaced from a bottom end and mounting said base at said bottom end, said housing having a lamp supporting element at said top end for mountingly receiving a fluorescent illumination element having electrical contacts and having a tubular portion extending between said base at said bottom end and said supporting element at said top end, said housing having one or more apertures to permit light resulting from ambient conditions and from illumination of said fluorescent lamp element and from other illumination sources to enter said housing through said apertures, a controllable electrical circuit disposed within said housing and connected with the electrical conductors of said base for receiving electrical power and having output conductors for electrical connection to the contacts of a fluorescent illumination element mountingly received in said supporting element and for applying an adjustable variable operating electrical excitation to a fluorescent illumination element in response to a controllable electrical signal, one or more light sensing elements disposed within said housing and in electrical connection with said controllable electrical circuit, and one or more optical adjustment elements for controlling the entry of said light through said apertures, thereby controlling impingement of said light onto said light sensing elements for producing said controllable signal in response to adjustable positioning of said optical adjustment elements, said optical adjustment elements being manually accessible externally of said housing tubular portion.

8. Dimmable fluorescent lamp apparatus comprising an electrically insulative housing having a top end axially spaced from a bottom end and mounting a base at said bottom end, said housing having lamp supporting means at said top end for mountingly receiving a fluorescent illumination element having electrical contacts and having a tubular portion extending between said base at said bottom end and said supporting means at said top end, said housing having one or more apertures to permit light resulting from ambient conditions and from illumination of said fluorescent lamp element and from other illumination sources to enter said housing through said apertures, controllable electrical circuit means disposed within said housing and connected with the electrical conductors of said base for receiving electrical power and further having output conductors for electrical connection to the contacts of a fluorescent illumination element mountingly received in said supporting means and for applying an adjustable variable operating electrical excitation to a fluorescent illumination element in response to a controllable electrical signal, light sensing means disposed within said housing and in electrical connection with said controllable electrical circuit means, optical adjustment means for controlling the entry of said light through said apertures, thereby controlling impingement of said light onto said light sensing means for producing said controllable signal in response to adjustable positioning of said optical adjustment means, said optical adjustment means being manually accessible externally of said housing tubular portion, and a manually positionable switch connected with said controllable electrical circuit means and with a source of electrical power for exciting said fluorescent illumination element, said switch being manually accessible externally of said housing tubular portion.

9. Electric circuit apparatus for dimmable operation of a fluorescent lamp, said apparatus comprising a rectifier for producing a rectified voltage in response to an alternating supply voltage, output terminals for connection to a fluorescent lamp device, a controlled converter connected with said rectifier and applying switched current to said output terminals for operating a fluorescent lamp device connected thereto, with a parameter of the switched current responsive to the signal at a control input for selectively dimming the resultant illumination from a relatively maximal level, a dimming control stage connected with the control input of the controlled converter and having a photoresponsive circuit element for applying to the control input a signal selectively responsive to the level of light incident on the photoresponsive circuit element, and an adjustable optical occluder in optical alignment with the photoresponsive circuit element for selecting the signal produced at the control input for a given light condition.

10. Dimmable fluorescent lamp apparatus comprising an electrical socket base for threading into an electrical lamp socket and having electrical conductors arranged for electrical connection with corresponding conductors of the electrical lamp socket, an electrically insulative housing having a top end axially spaced from a bottom end and mounting said base at said bottom end, said housing having lamp supporting means at said top end for mountingly receiving a fluorescent illumination element having electrical contacts and having a tubular portion extending between said base at said bottom end and said supporting means at said top end, said housing having one or more apertures to permit light resulting from ambient conditions and from illumination of said fluorescent lamp element and from other illumination sources to enter said housing through said apertures, controllable electrical circuit means disposed within said housing and connected with the electrical conductors of said base for receiving electrical power and having output conductors for electrical connection to the contacts of a fluorescent illumination element mountingly received in said supporting means and applying an adjustable variable operating electrical excitation to a fluorescent illumination element in response to a controllable electrical signal, light sensing means disposed within said housing and in electrical connection with said controllable electrical circuit means, and optical adjustment means for controlling the entry of said light through said apertures, thereby controlling impingement of said light onto said light sensing means for producing said controllable signal in response to adjustable positioning of said optical adjustment means, said optical, adjustment means being manually accessible externally of said housing tubular portion and further comprising a manually positionable ring member rotatable about an axis of said housing extending between said base and said top end.

11. Dimmable fluorescent lamp apparatus according to claim 10, wherein said manually positionable ring member further comprises one or more aperture occluders proximal to each of said apertures and movable across each of said apertures in response to movement of said ring member for variable occlusion of light impinging on said light sensing means.

12. Dimmable fluorescent lamp apparatus according to claim, 11 wherein said aperture occluders are integrally formed with said ring member.

* * * * *